US008881623B2

(12) United States Patent
Bernede

(10) Patent No.: US 8,881,623 B2
(45) Date of Patent: Nov. 11, 2014

(54) LEVEL CORKSCREW HAVING A DOUBLE FULCRUM AND METHOD OF USING SAME

(75) Inventor: Philippe Bernede, Vire sur Lot (FR)

(73) Assignee: Distri Coutale, Vire sur Lot (FR)

( * ) Notice: Subject to any disclaimer, the term of this patent is extended or adjusted under 35 U.S.C. 154(b) by 202 days.

(21) Appl. No.: 13/499,089

(22) PCT Filed: Oct. 5, 2010

(86) PCT No.: PCT/FR2010/052096

§ 371 (c)(1),
(2), (4) Date: Mar. 29, 2012

(87) PCT Pub. No.: WO2011/045502

PCT Pub. Date: Apr. 21, 2011

(65) Prior Publication Data

US 2012/0222280 A1 Sep. 6, 2012

(30) Foreign Application Priority Data

Oct. 14, 2009 (FR) ..... 09 57202

(51) Int. Cl.

| | |
|---|---|
| ***B67B 7/44*** | (2006.01) |
| ***B67B 7/18*** | (2006.01) |
| ***B67B 7/00*** | (2006.01) |
| ***B67B 7/02*** | (2006.01) |
| ***B67B 7/42*** | (2006.01) |
| ***B67B 7/16*** | (2006.01) |
| ***B67B 7/04*** | (2006.01) |

(52) U.S. Cl.

CPC ..... *B67B 7/0429* (2013.01)
USPC ..... 81/3.47; 81/3.09

(58) Field of Classification Search

CPC ..... B67B 7/44; B67B 7/18; B67B 7/00; B67B 7/02; B67B 7/42; B67B 7/16; B67B 207/04588
USPC ..... 29/426.1, 426.5; 7/154, 155; 81/3.09, 81/3.29, 3.45, 3.47, 3.48, 3.55, 3.56, 3.57
See application file for complete search history.

(56) References Cited

U.S. PATENT DOCUMENTS 4,437,359 A * 3/1984 Dejoux et al. ..... 81/3.09
4,996,895 A * 3/1991 Brucart Puig ..... 81/3.09

(Continued)

FOREIGN PATENT DOCUMENTS

| | | |
|---|---|---|
| EP | 0 041 026 | 12/1981 |
| FR | 2873108 | 1/2008 |

*Primary Examiner* — Essama Omgba
*Assistant Examiner* — Darrell C Ford
(74) *Attorney, Agent, or Firm* — Ted Sabety, Esq.; Sabety + Associates PLLC

(57) ABSTRACT

The invention relates to a corkscrew (T) including a handle (100) to which are connected a worm (200) and two separate levers (300, 400) pivotably connected in a case on a single pin (A) secured to the handle and preformed to provide the two notches or two fulcra (310, 410) that are required in order to extract a cork (B) inserted in the neck (G) of a bottle, in two steps. Said corkscrew is characterized in that the two levers include two portions, the second portion (330) of the first lever (300) being preformed such as to be inserted in the second portion (430) of the second lever (400) and create a fulcrum on the neck (G) of the bottle when the corkscrew (T) passes from the first notch (310) to the second notch (410) such that said first notch (310) does not project in relation to the second notch (410) and said first notch (310) does not prevent said passing. The invention also relates to the method for using the corkscrew described above. The invention is useful for manufacturing corkscrews.

7 Claims, 5 Drawing Sheets

(56) References Cited

U.S. PATENT DOCUMENTS

| | | | | |
|---|---|---|---|---|
| 6,101,900 | A * | 8/2000 | Traspuesto | 81/3.48 |
| 6,176,154 | B1 * | 1/2001 | Brucart Puig et al. | 81/3.47 |
| 6,732,611 | B2 * | 5/2004 | Miguel | 81/3.29 |
| 6,752,040 | B1 * | 6/2004 | Paul-Alexandre et al. | 81/3.09 |
| 6,820,519 | B2 * | 11/2004 | Lefebvre | 81/3.47 |
| 7,272,992 | B2 * | 9/2007 | Farfalli et al. | 81/3.09 |
| D576,003 | S * | 9/2008 | Patrizio et al. | D8/40 |
| D599,635 | S * | 9/2009 | Hasegawa | D8/43 |
| 7,614,322 | B1 * | 11/2009 | Corredor-Londono | 81/3.09 |
| 7,614,323 | B2 * | 11/2009 | Warner | 81/3.47 |
| 2002/0157188 | A1 * | 10/2002 | Sannajust | 7/156 |
| 2002/0174489 | A1 * | 11/2002 | Puig | 7/155 |
| 2003/0097910 | A1 * | 5/2003 | Warner | 81/3.47 |
| 2013/0269486 | A1 * | 10/2013 | Gasman | 81/3.37 |
| 2014/0020512 | A1 * | 1/2014 | Burato | 81/3.09 |

* cited by examiner

LEVEL CORKSCREW HAVING A DOUBLE FULCRUM AND METHOD OF USING SAME

PRIORITY CLAIM

This application is the U.S. National Stage application of PCT/FR2010/052096 filed on Oct. 5, 2010, and claims priority as a continuation to French application 0957202 filed on Oct. 14, 2009, both of which are incorporated herein by reference in their entireties.

FIELD OF APPLICATION OF THE INVENTION

The present invention relates to the field of lever corkscrews having a double fulcrum and in particular to the adaptations which make it possible to facilitate the manufacturing and use thereof.

BACKGROUND OF THE INVENTION

The lever corkscrew (also known as a "waiter's friend") having a double fulcrum, such as that described in the document EP 0 041 026, is a corkscrew composed of a handle on which is articulated a worm and a lever preformed with two notches forming two fulcra permitting the effortless extraction of corks in two steps.

One embodiment of this corkscrew proposes one single lever with two notches preformed in this latter. This embodiment has the drawback that as the first fulcrum or notch is not retractable, this latter being used first abuts the cork when the second fulcrum or notch is to be used.

Another embodiment proposes two separate levers articulated in a case on one and the same pin secured to the handle, a small lever including the notch corresponding to the fulcrum of the first step retracting within a larger lever intended for the second step. Nevertheless, the course of the small lever outside the first one is not controlled, requiring a certain amount of practice in order for this embodiment to be used effectively.

More recently, a double lever with a first retractable fulcrum has been proposed in the document FR 2873108. The corkscrew described in this document comprises two separate levers articulated in a case on one and the same pin secured to the handle, the small lever including the notch corresponding to the fulcrum of the first step retracting within a larger lever intended for the second step. A spring provided on the articulation retains the first lever in a retracted position within the second lever, in the absence of pressure from the user. A tab joined to the small lever co-operates with parts joined to the second lever in order to limit the rotation of the small lever within the large lever.

This lever has the drawback that it necessitates a spring in order to retract the first lever within the second one which adds to the cost of this corkscrew.

Another drawback noted by the applicant relates to the manipulation of the folding blade conventionally integrated into the handle and articulated on the same pin as the levers. This blade is extended before use of the worm, for the purpose of cutting the material covering the neck in order to give access to the cork. Once the cork is accessible, this blade is folded back in the handle, the levers and the worm are extended and the worm is screwed into the cork. Because of its small size and stresses on its pivot pin, the extension and the folding of this blade are awkward operations.

SUMMARY OF THE INVENTION

Starting from this situation, the applicant conducted research aiming to obviate the aforementioned drawbacks.

This research led to the conception and the implementation of a corkscrew, simplifying the levers of which it is composed and facilitating the manipulation of the integrated blade.

The corkscrew according to the invention is of the type comprising a handle on which are articulated a worm and two separate levers which are articulated in a case on a single pin secured to the handle and are preformed to provide the two notches or two fulcra necessary for the extraction of a cork engaged in the neck (G) of a bottle, in two steps.

According to the principal characteristic of the invention, the first lever comprises two parts:

- a first part close to the pivot pin and connected to this latter having a U-shaped profile of which distal end forms the fulcrum serving as the first notch on the neck of the bottle for the first step,
- a second part joined to the first one extending from the first beyond its fulcrum and forming a mechanical abutment coming into contact with the cylindrical surfaces of the neck of the bottle, and
- the second lever also comprises two parts: a first part close to the pivot pin and joined to this latter,
- a first part close to the pivot pin and connected to this latter having a U-shaped profile of which the distal end forms a fulcrum serving as the second notch or fulcrum against the neck of the bottle for the second step,
- the said second part of the first lever being preformed in such a way that it is accommodated in the said second part of the second lever and forms a fulcrum against the cylindrical surfaces of the neck of the bottle when the corkscrew passes from the first notch to the second notch in such a way that the said first notch does not project with respect to the second and that the said first notch does not impede the said passage.

This characteristic is particularly advantageous in that it avoids the presence of a spring for the return of the first notch by exploiting the contact with the bottle in order to ensure that the first notch retracts within the second one or at least has a projection less than that formed by the second notch when the corkscrew passes from the first support phase to the second.

This absence of a spring makes it possible to reduce the cost of such a corkscrew.

Other characteristics which may or may not be combined also participate in the invention; among these:

- the first part of the second lever fits into the U-shaped profile of the first part of the first lever,
- the branches of the U-shaped profile of the said first part of the first lever and those of the U-shaped profile of the second part of the second lever are coplanar in pairs,
- the said second part of the first lever is composed of a flat profile of which the deformation makes it possible to create a projection which extends beyond the plane of the base of the U formed by the two levers and is interposed between the parts forming this U,
- the said second part of the first lever is longer than the said second lever,
- the said U-shaped profile forming the first part of the first lever is preformed with a window having the shape necessary for it to function as a bottle opener.

On the other hand the corkscrew according to the invention is remarkable in that it includes a folding blade articulated on the same pin as the two lever and of which the side opposite the cutting edge co-operates with a mechanical abutment defined on one of the levers such that the unfolding of this lever ensures the folding of the blade. This characteristic is particularly advantageous in that it makes it possible to effect the folding of the blade by the extension of the levers, extension which corresponds to the following operation in the extraction process.

The invention also relates to the method of use of such a corkscrew which is remarkable in that, during the passage from the first fulcrum to the second, by action of the user on the projection described above the second part of the first lever is put in contact against the neck of the bottle in order to make the first part of the first lever recoil with respect to the second part of the second lever and guarantee that the first notch does not impede the use of the second notch.

The fundamental concepts of the invention which have been set out above in their most elementary form, other details and characteristics will become more apparent upon reading of the following description and with regard to the appended drawings, giving by way of non-limiting example an embodiment of a corkscrew and the method of use thereof according to the invention.

DESCRIPTION OF PREFERRED EMBODIMENTS

Figure 1:
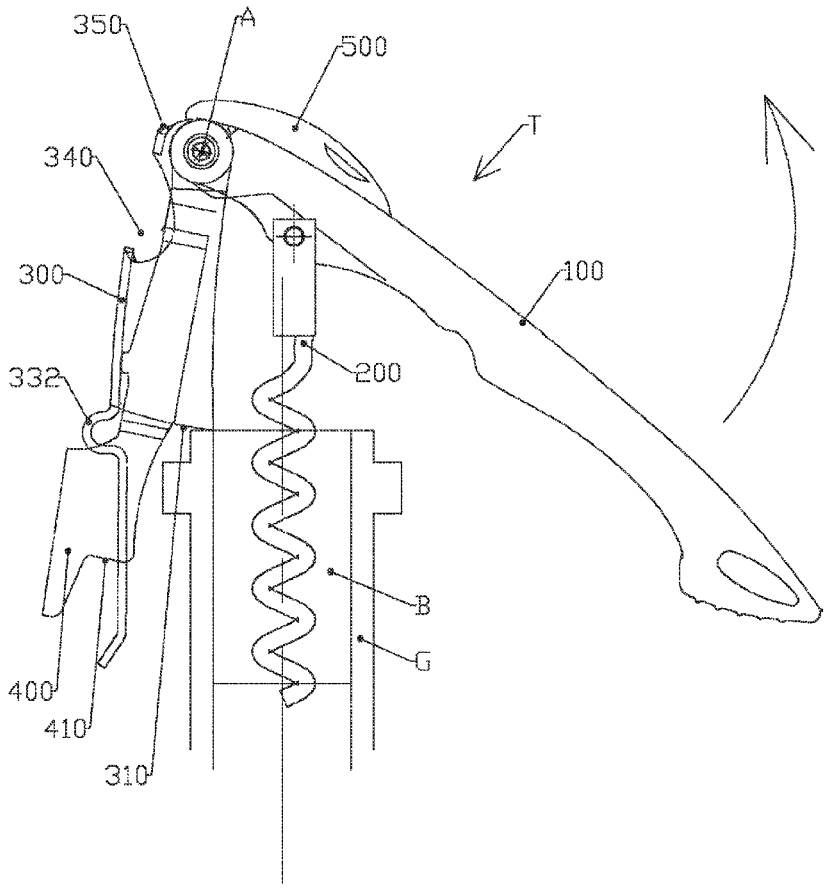
FIG. 1 shows a schematic drawing in a side view of an embodiment of a corkscrew according to the invention at the start of the first support phase.
Figure 2:
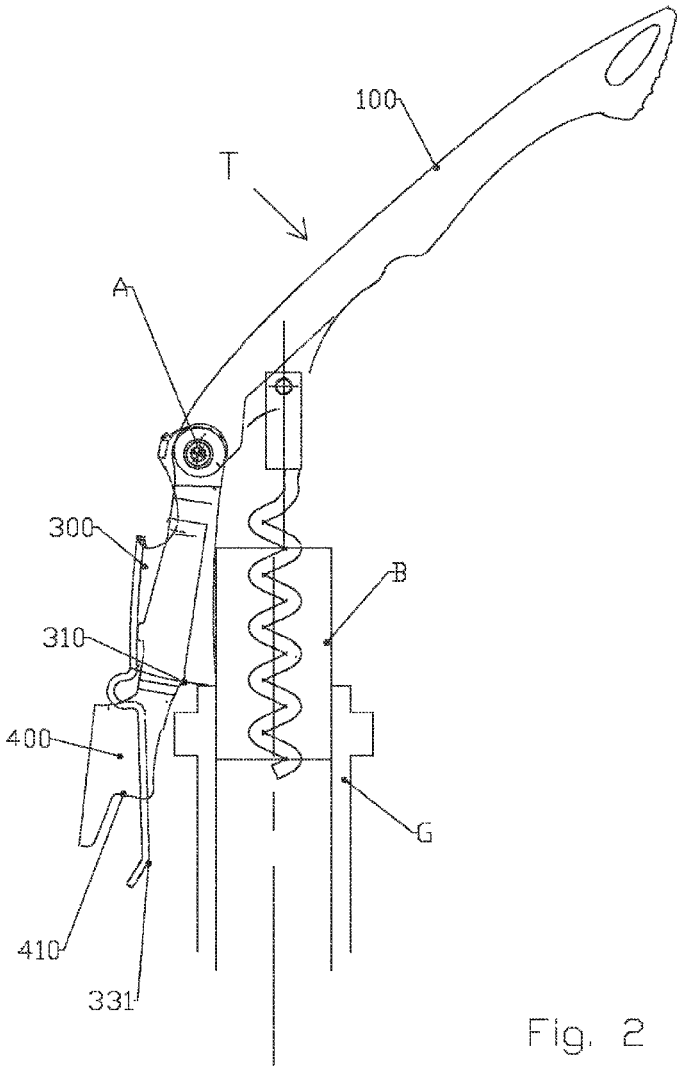
FIG. 2 shows a schematic drawing of the end of the second support phase in a side view of an embodiment.
Figure 3:
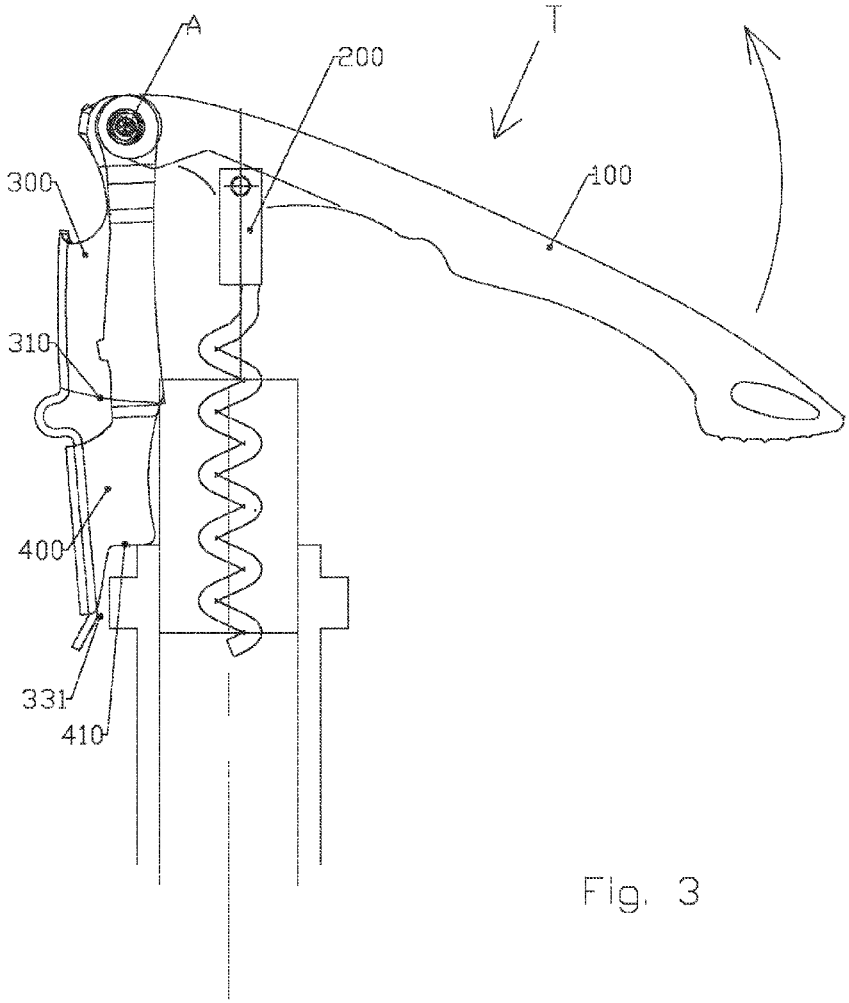
FIG. 3 shows a schematic drawing of the start of the second support phase.
Figure 6:
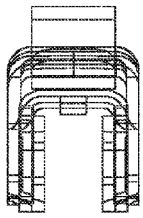
FIG. 6 shows a schematic drawing of a top view.

As shown in FIGS. 1 to 3 of the drawings, the corkscrew referenced T as a whole is of the type comprising a handle 100 on which are articulated a worm 200 and two separate levers 300 and 400 articulated in a case on a single pin A secured to the handle. The worm 200 is screwed into the cork B inserted into the neck G of the bottle.

In accordance with the principles of a double lever corkscrew, a first lever 300 is preformed in order to provide a fulcrum 310 corresponding to a first step of extraction illustrated by FIGS. 1 and 2. In order to extract the cork B completely, once the first step of extraction is terminated the first fulcrum 310 is replaced by a second fulcrum 410 preformed in the second lever 400.

In accordance with the invention as illustrated in the drawings in FIGS. 4 to 8, the first lever 300 is made up of two parts 320 and 330:

- a first part 320 close to the pivot pin A which, having a U-shaped profile, is joined at a first end to the said pin A and forms on its second end the said fulcrum 310 serving as the first notch or the first fulcrum for corkscrew T against the top of the neck G of the bottle, namely against the planar circular crown defined on the top of this neck G,
- a second part 330 joined to the first one extending from the first beyond its fulcrum and forming a mechanical abutment 331 perpendicular to the said fulcrum 310. This mechanical abutment co-operates with the cylindrical surfaces of the neck G with the advantages which will be discussed in greater detail below.

According to a preferred embodiment the fulcrum 310 defined at the end of the first part 320 of the first lever 300 is rounded in order to offer an optimal fulcrum irrespective of the angular position of the lever.

The second lever 400 which is larger than the first also includes two parts:

- a first part 420 close to the pivot pin A, joined to this latter and composed of two parallel arms which fit into the U shape formed by the first part 320 of the first lever 300, are preformed at a first end of an orifice co-operating with the pivot pin A and at a second end joined to the second part,
- a second part 430 which is joined to the first has a U-shaped profile of which the distal end forms the fulcrum 410 serving as the second notch or fulcrum against the top of the neck G of the bottle.

As illustrated in the drawings in FIGS. 2 and 3, the said second part 330 of the first lever 300 is preformed in such a way that it is accommodated in the said second part 430 of the second lever 330 and forms a fulcrum 331 against the cylindrical surfaces of the neck of the bottle when the corkscrew T and the said levers pass from a first notch to the second notch in such a way that the said first notch does not project with respect to the second and does not impede the said passage illustrated by the said figures. The term "U shaped profile" refers to the concavely curved shape of the side of the levers on the bottle side of the corkscrew, (320), (430). The U-shaped profile causes the levers to smoothly move from one position to the other as the handle is moved.

As illustrated, the said second part 330 of the first lever 300 is longer than the said second lever 400 guaranteeing its contact with the neck before that of the second lever 400.

Moreover, the lower end of this second part is provided with a tab forming a spatula facilitating the sliding of this part of the first lever on the cylindrical body of the neck.

The branches of the U-shaped profile of the said first part 320 of the first lever 300 and those of the U-shaped profile of the second part 430 of the second lever 400 are coplanar in pairs.

In order to enable the action by the user on the rotation of the first level with respect to the second one in order to cause the said first fulcrum 310 to project, the said second part 330 of the first lever 300 is composed of a flat profile of which the deformation makes it possible to create a projection 332 which extends beyond the plane of the base of the U formed by the two levers 300 and 400 and is interposed between the parts 320 and 420 forming this U. This projection 332 is created by means of a rounded fold of the planar profile forming the said second part 330 of the first lever 300.

Figure 4:
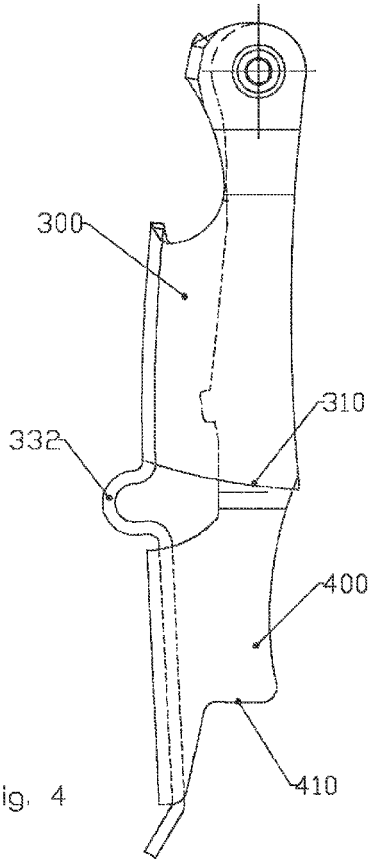
FIG. 4 shows a schematic drawing of a side view of the two levers disposed in a rest position.
Figure 5:
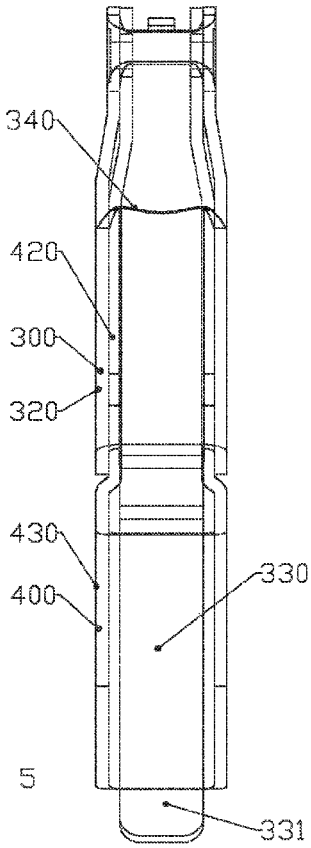
FIG. 5 shows a schematic drawing of a front view of the same position.
Figure 8:
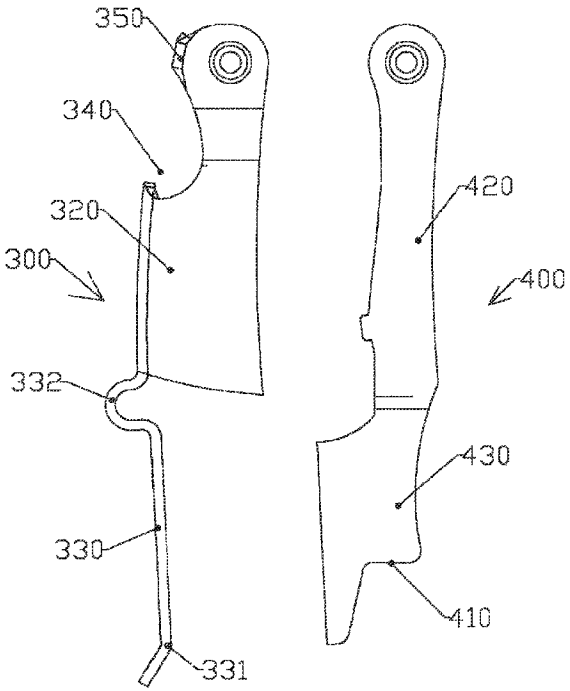
FIG. 8 shows a schematic drawing of a side view of the two separate levers.
Figure 7:
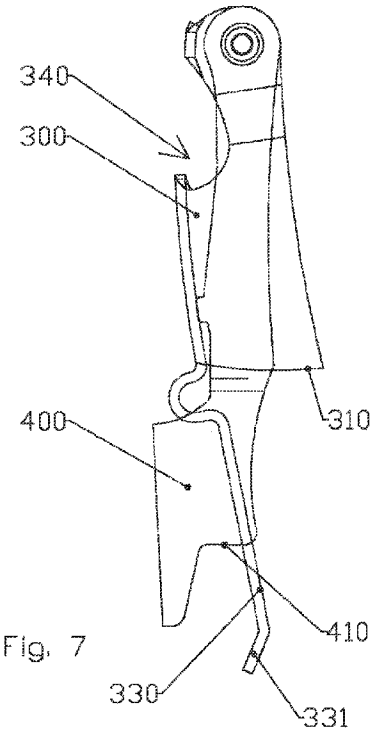
FIG. 7 shows a schematic drawing of a side view of the two levers with the first lever projecting with respect to the second one.

In the rest position illustrated by the drawing in FIG. 4, the first part 420 of the second lever 400 is fitted into the first part 320 of the first lever 300 and the second part 330 of the first lever 300 is disposed in the second part 430 of the second lever 400. The action of the user on the projection 332 makes it possible to cause the first fulcrum 310 to project with respect to the second lever 400. The contact between the abutment 331 and the cylindrical surface of the neck during the rise of the second fulcrum 410 ensures the retraction of the first fulcrum with respect to the second.

According to the preferred embodiment which is illustrated, the said U-shaped profile forming the first part of the first lever is preformed with a window 340 having the shape necessary for it to function as a bottle opener.

As is illustrated in the drawing in FIG. 1, the corkscrew T also includes a folding blade 500 articulated on the same pin as the two levers 300 and 400 and of which the side opposite the cutting edge co-operates with a mechanical abutment 350 defined on one of the levers such that the unfolding of this lever ensures the folding of the blade.

It will be understood that the corkscrew and the method of use thereof which have been described above and illustrated have been offered by way of a disclosure rather than a limitation. Naturally, various arrangements, modifications and improvements could be made to the above example without in any way departing from the scope of the invention.

The invention claimed is:

1. A corkscrew for extracting a cork from the neck of a bottle comprising:

a handle comprised of a first pivot pin to which is articulated a worm and a second pivot pin to which is articulated a first lever and a second lever, where both levers are shaped in order to provide a first and a second notch that in operation act as a first and second corresponding fulcrum during the extraction of the cork, where the first lever is comprised of a first part of the first lever mounted to the second pivot pin, and the first part of the first lever having a distal end that forms the first notch which serves in operation as the first fulcrum for extracting the cork, and a second part of the first lever joined to the first part of the first lever and extending from the first part of the first lever past the first fulcrum and forming a mechanical abutment that in operation comes into contact with the cylindrical surfaces of the neck of the bottle; and where the second lever is comprised of a first part of the second lever mounted to the second pivot pin, and a second part of the second lever joined to the first part of the second lever, having a distal end that forms a second notch serving in operation as the second fulcrum against the neck of the bottle for extracting the cork, where the said second part of the first lever is shaped in such a way that the second part of the first lever it is accommodated in the said second part of the second lever and, in operation forms a fulcrum against the cylindrical surfaces of the neck of the bottle when the corkscrew position moves from the first notch to the second notch in such a way that the said first notch does not project with respect to the second notch and that the said first notch does not impede said movement, and where the distal end of the second part of the first lever extends past the notch formed by the second lever, where the first part of the first lever is comprised of a U-shaped profile and the first part of the second lever fits into the U-shaped profile of the first part of the first lever.

2. A corkscrew for extracting a cork from the neck of a bottle comprising:

a handle comprised of a first pivot pin to which is articulated a worm and a second pivot pin to which is articulated a first lever and a second lever, where both levers are shaped in order to provide a first and a second notch that in operation act as a first and second corresponding fulcrum during the extraction of the cork, where the first lever is comprised of a first part of the first lever mounted to the second pivot pin, and the first part of the first lever having a distal end that forms the first notch which serves in operation as the first fulcrum for extracting the cork, and a second part of the first lever joined to the first part of the first lever and extending from the first part of the first lever past the first fulcrum and forming a mechanical abutment that in operation comes into contact with the cylindrical surfaces of the neck of the bottle; and where the second lever is comprised of a first part of the second lever mounted to the second pivot pin, and a second part of the second lever joined to the first part of the second lever, having a distal end that forms a second notch serving in operation as the second fulcrum against the neck of the bottle for extracting the cork, where the said second part of the first lever is shaped in such a way that the second part of the first lever it is accommodated in the said second part of the second lever and, in operation forms a fulcrum against the cylindrical surfaces of the neck of the bottle when the corkscrew position moves from the first notch to the second notch in such a way that the said first notch does not project with respect to the second notch and that the said first notch does not impede said movement, and where the distal end of the second part of the first lever extends past the notch formed by the second lever, where the first part of the first lever is comprised of a U-shaped profile and the U-shaped profile of the said first part of the first lever and those of a U-shaped profile of the second part of the second lever are coplanar in pairs.

3. A corkscrew for extracting a cork from the neck of a bottle comprising:

a handle comprised of a first pivot pin to which is articulated a worm and a second pivot pin to which is articulated a first lever and a second lever, where both levers are shaped in order to provide a first and a second notch that in operation act as a first and second corresponding fulcrum during the extraction of the cork, where the first lever is comprised of a first part of the first lever mounted to the second pivot pin, and the first part of the first lever having a distal end that forms the first notch which serves in operation as the first fulcrum for extracting the cork, and a second part of the first lever joined to the first part of the first lever and extending from the first part of the first lever past the first fulcrum and forming a mechanical abutment that in operation comes into contact with the cylindrical surfaces of the neck of the bottle; and where the second lever is comprised of a first part of the second lever mounted to the second pivot pin, and a second part of the second lever joined to the first part of the second lever, a distal end that forms a second notch serving in operation as the second fulcrum against the neck of the bottle for extracting the cork, where the said second part of the first lever is shaped in such a way that the second part of the first lever it is accommodated in the said second part of the second lever and, in operation forms a fulcrum against the cylindrical surfaces of the neck of the bottle when the corkscrew position moves from the first notch to the second notch in such a way that the said first notch does not project with respect to the second notch and that the said first notch does not impede said movement, and where the distal end of the second part of the first lever extends past the notch formed by the second lever, where the said second part of the first lever is comprised of a U-shaped surface, said U-shaped surface having a base, and a flat profile that in operation causes a projection to extend beyond a plane defined by the base of the U-shaped surface and is interposed between the parts of the first and second levers forming the U-shaped profile of the first part of the first lever.

4. A corkscrew for extracting a cork from the neck of a bottle comprising:

a handle on which are articulated a worm and a first lever and a second lever, where both levers are articulated in a case on a pivot pin joined to the handle and are shaped in order to provide a first and a second notch that in operation act as a first and second corresponding fulcrum during the extraction of the cork, where the first lever is comprised of a first part of the first lever mounted to the pivot pin, the first part of the first lever having a U-shaped profile of which the distal end forms the first notch which serves in operation as the first fulcrum for extracting the cork, and a second part of the first lever joined to the first part of the first lever and extending from the first part of the first lever past the first fulcrum and forming a mechanical abutment that in operation comes into contact with the cylindrical surfaces of the neck of the bottle; and the second lever comprised of a first part of the second lever mounted to the pivot pin, and a second part of the second lever joined to the first part of the second lever, having a U-shaped profile of which the distal end forms a second notch serving in operation as the second fulcrum against the neck of the bottle for extracting the cork, where the said second part of the first lever is shaped in such a way that the second part of the first lever is accommodated in the said second part of the second lever and, in operation forms a fulcrum against the cylindrical surfaces of the neck of the bottle when the corkscrew position moves from the first notch to the second notch in such a way that the said first notch does not project with respect to the second notch and that the said first notch does not impede said movement and where the first part of the second lever fits into the U-shaped profile of the first part of the first lever.

5. Corkscrew as claimed in claim 4, where the U-shaped profile of the said first part of the first lever and those of the U-shaped profile of the second part of the second lever are coplanar in pairs.

6. Corkscrew as claimed in claim 4, where the said second part of the first lever is comprised of U-shaped surface, said U-shaped surface having a base, and a flat profile that in operation causes a projection to extend beyond a plane defined by the base of the U-shaped surface and is interposed between the parts of the first and second levers forming the U-shaped profile.

7. Corkscrew as claimed in claim 4, where the said U-shaped profile forming the first part of the first lever is shaped so that in use, the profile establishes a fulcrum along the top of the bottle.

* * * * *